US008556371B2

(12) United States Patent
Toya

(10) Patent No.: US 8,556,371 B2
(45) **Date of Patent: *Oct. 15, 2013**

(54) RECORDING DEVICE AND METHOD FOR CONTROLLING RECORDING DEVICE

(75) Inventor: Akihiro Toya, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 80 days.

This patent is subject to a terminal disclaimer.

(21) Appl. No.: 13/177,731

(22) Filed: Jul. 7, 2011

(65) Prior Publication Data

US 2012/0013670 A1 Jan. 19, 2012

(30) Foreign Application Priority Data

Jul. 16, 2010 (JP) ..... 2010-162022

(51) Int. Cl.
*B41J 29/38* (2006.01)

(52) U.S. Cl.
USPC ..... 347/16

(58) Field of Classification Search
None
See application file for complete search history.

(56) References Cited

U.S. PATENT DOCUMENTS

2012/0013669 A1* 1/2012 Toya ..... 347/16

FOREIGN PATENT DOCUMENTS

JP 2005-246908 A 9/2005

* cited by examiner

*Primary Examiner* — Stephen Meier
*Assistant Examiner* — Tracey McMillion
(74) *Attorney, Agent, or Firm* — Global IP Counselors, LLP

(57) ABSTRACT

A recording device includes a conveying part that conveys roll paper, a support part that supports the roll paper, a recording part that that ejects liquid and records an image on the roll paper; a heating part that heats the support part to dry the liquid discharged on the roll paper, a cleaning part that cleans the recording part, and a controller that causes the conveying part to convey the roll paper at a first speed when the recording part performs a recording action for recording the image, and causes the conveying part to convey the roll paper at a second speed, which is slower than the first speed, after the cleaning part performs a cleaning action for cleaning the recording part.

5 Claims, 4 Drawing Sheets

RECORDING DEVICE AND METHOD FOR CONTROLLING RECORDING DEVICE

CROSS-REFERENCE TO RELATED APPLICATIONS

This application claims priority to Japanese Patent Application No. 2010-162022 filed on Jul. 16, 2010. The entire disclosure of Japanese Patent Application No. 2010-162022 is hereby incorporated herein by reference.

BACKGROUND

1. Technical Field

The present invention relates to a recording device for recording an image on roll paper and a method for controlling a recording device.

2. Related Art

There is already a known recording device which comprises a conveying part for conveying roll paper, a support part for supporting the roll paper, a recording part for discharging a liquid and recording an image on the roll paper which is being supported by the support part, a heating part for drying the liquid discharged on the roll paper by heating the support part, and a cleaning part for cleaning the recording part (see, Japanese Laid-Open Patent Application Publication No. 2005-246908)

SUMMARY

However, a problem in conventional practice is that when the roll paper is conveyed after cleaning of the recording part is performed by the cleaning part, there are cases in which wrinkles occur in the roll paper.

The present invention was devised in view of such conventional problems, and an object thereof is to minimize the occurrence of wrinkles in the roll paper.

A recording device according to one aspect of the present invention includes a conveying part, a support part, a recording part, a heating part, a cleaning part and a controller. The conveying part is configured and arranged to convey a roll paper. The support part is configured and arranged to support the roll paper. The recording part is configured and arranged to eject liquid on the roll paper to record an image on the roll paper supported by the support part. The heating part is configured and arranged to heat the support part to dry the liquid ejected onto the roll paper. The cleaning part is configured and arranged to clean the recording part. The controller is configured to control the conveying part to convey the roll paper at a first speed when the recording part performs a recording action for recording the image, and to control the conveying part to convey the roll paper at a second speed, which is slower than the first speed, after the cleaning part performs a cleaning action for cleaning the recording part.

Other characteristics of the present invention are made clear by the content of the present specification and the accompanying drawings.

BRIEF DESCRIPTION OF THE DRAWINGS

Referring now to the attached drawings which form a part of this original disclosure.

DETAILED DESCRIPTION OF EXEMPLARY EMBODIMENTS

Figure 1:
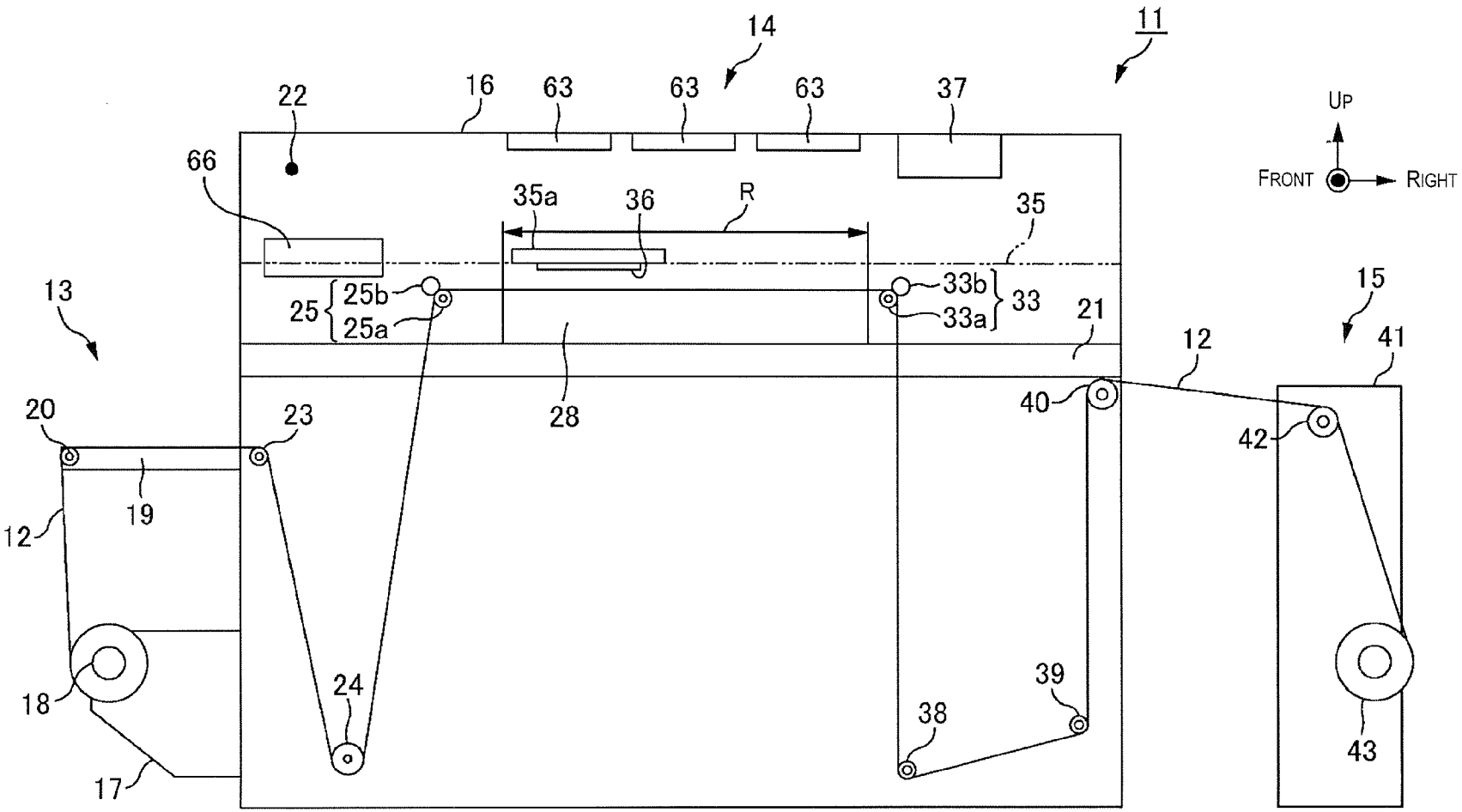
FIG. 1 is a schematic front view of a printer 11.

The following matters at least will be made clear from the content of the present specification and the accompanying drawings.

A recording device according to the embodiment of the present invention includes a conveying part, a support part, a recording part, a heating part, a cleaning part and a controller. The conveying part is configured and arranged to convey a roll paper. The support part is configured and arranged to support the roll paper. The recording part is configured and arranged to eject liquid on the roll paper to record an image on the roll paper supported by the support part. The heating part is configured and arranged to heat the support part to dry the liquid ejected onto the roll paper. The cleaning part is configured and arranged to clean the recording part. The controller is configured to control the conveying part to convey the roll paper at a first speed when the recording part performs a recording action for recording the image, and to control the conveying part to convey the roll paper at a second speed, which is slower than the first speed, after the cleaning part performs a cleaning action for cleaning the recording part.

According to this recording device, the occurrence of wrinkles in the roll paper can be minimized.

In the recording device, the conveying part may include a plurality of rollers over which the roll paper wraps, the rollers including a proximal roller at a position nearest to the support part among the rollers disposed upstream of the support part in the conveying direction. The controller may be configured to, after the cleaning part performs the cleaning action for cleaning the recording part, control the conveying part to convey the roll paper at the second speed until a region of the roll paper wrapped over the proximal roller during the cleaning action is conveyed past an upstream end of the support part with respect to the conveying direction, and control the conveying part to convey the roll paper at a faster speed than the second speed after the region has been conveyed past the upstream end of the support part.

According to this recording device, the roll paper can be conveyed in a short amount of time while the occurrence of wrinkles in the roll paper is minimized.

The recording device may further include a suction part configured and arranged to hold the roll paper to the support part by suction. The controller may be configured to control the suction part to use a first suction force to hold the roll paper to the support part by suction when the recording part performs a recording action for recording the image, and to control the suction part to use a second suction force, which is weaker than the first suction force, to hold the roll paper to the support part by suction when the cleaning part performs a cleaning action for cleaning the recording part.

According to this recording device, the occurrence of wrinkles in the roll paper can be minimized more reliably.

The recording device may further include a fan configured and arranged to blow air toward the roll paper to dry the liquid discharged onto the roll paper. The controller may be configured to actuate the fan when the recording part performs the recording action for recording the image and when the cleaning part performs the cleaning action for cleaning the recording part.

According to this recording device, the occurrence of wrinkles in the roll paper can be minimized more reliably.

A method for controlling a recording device according to the embodiment includes: when a recording part performs a recording action for discharging a liquid and recording an image on a roll paper supported by a heated support part, controlling a conveying part to convey, at a first speed, the roll paper supported by the support part; and after a cleaning part performs a cleaning action for cleaning the recording part, controlling the conveying part to convey, at a second speed that is slower than the first speed, the roll paper supported by the support part.

According to this method for controlling a recording device, the occurrence of wrinkles in the roll paper can be minimized.

First Embodiment

The first embodiment in which the recording device of the present invention is specified as an inkjet printer (hereinbelow referred to as a "printer") is described hereinbelow based on the drawings. In the following description, when an "up-down direction" and a "left-right direction" are mentioned, they are referencing the directions shown by the arrows in FIG. 1. When a "forward-backward direction" is mentioned, it indicates the direction orthogonal to the paper surface of FIG. 1.

Configuration of Printer

FIG. 1 is a schematic front view of the printer 11 of the first embodiment.

The printer 11 as a recording device of the first embodiment comprises a main body 14 for sequentially performing printing in sequence on roll paper 12 unreeled from an unreeling part 13 for unreeling the roll paper 12, and a winding part 15 for winding up the roll paper 12 that has undergone the recording action in the main body 14, as shown in FIG. 1. The main body 14 has a main body case 16 shaped as a right-angled parallelepiped. The unreeling part 13 is set up to the left of the main body case 16, which is the upstream side in the conveying direction of the roll paper 12. The winding part 15 is set up to the right of the main body case 16, which is the downstream side in the conveying direction of the roll paper 12.

The unreeling part 13 has a support plate 17 extending to the left from the bottom end of the left surface of the main body case 16. On the left end of the support plate 17, a winding shaft 18 extending forward (toward the viewer in the direction orthogonal to the paper surface in FIG. 1) is supported to be capable of rotating relative to the support plate 17. The roll paper 12, which has been wound into a roll shape in advance, is supported on the winding shaft 18 to be capable of rotating integrally with the winding shaft 18.

The unreeling part 13 has a flat plate-shaped unreeling stand 19 extending horizontally to the left from the center of the left surface of the main body case 16. Rotatably provided to the distal end of the unreeling stand 19 is a relay roller 20 for engaging the roll paper unreeled from the winding shaft 18 and leading the roll paper to the top surface of the unreeling stand 19. The roll paper 12 is then conveyed to the right (toward the main body 14) along the top surface of the unreeling stand 19.

In a position slightly higher than the vertical center inside the main body case 16 of the main body 14, a flat plate-shaped base stand 21 is provided for dividing the main body case 16 interior into a top and bottom. The area above the base stand 21 in the main body case 16 is a printing chamber 22 for performing printing on the roll paper 12.

In the left wall of the main body case 16, an inlet port (not shown) is provided for conveying the roll paper 12 into the main body case 16 from the top surface of the unreeling stand 19. The main body 14 then has a relay roller 23 rotatably provided so as to face the inlet port at a nearby position.

A relay roller 24 is rotatably provided to the right and below the relay roller 23 inside the main body case 16. After the roll paper 12 has been conveyed into the main body case 16, the roll paper wraps over the relay roller 24 from the left and above and is conveyed so as to face a position approaching the left end of the printing chamber 22.

In a position near the left end of the printing chamber 22, a first conveying roller pair 25 (equivalent to the proximal roller) is provided for sandwiching and applying conveying force to the roll paper 12. The first conveying roller pair 25 is configured from a first drive roller 25*a* connected to a first conveying motor (see FIG. 3) 26 so as enable the transmission of motive power, and a first driven roller 25*b* disposed so as to face the first drive roller 25*a* from the other side of the roll paper 12. As the first drive roller 25*a* is rotatably driven, the roll paper 12 which wraps over the first drive roller 25*a* from the left and below is conveyed horizontally to the right. A platen 28 (one example of a support part) is provided in an area to the right of the first conveying roller pair 25 inside the printing chamber 22. Specifically, the first conveying roller pair 25 is provided to a position near the upstream end of the platen 28.

Figure 2:
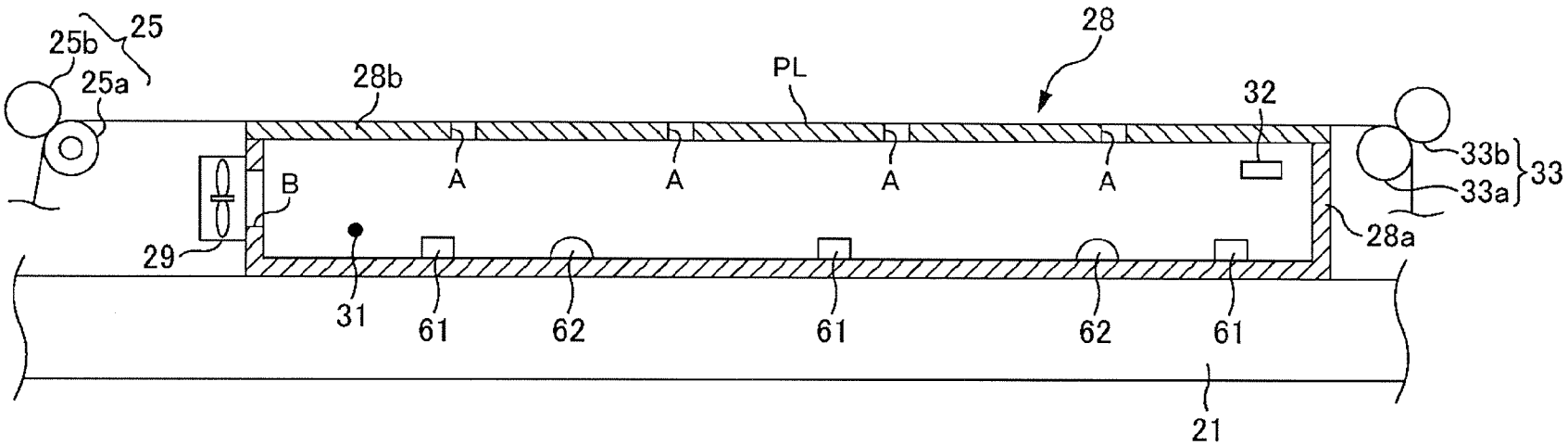
FIG. 2 is a cross-sectional view of a platen 28.

The platen 28 has a support stand 28*a* provided in a state of being supported on the base stand 21, the support stand 28*a* having a bottomed substantial box shape open in the top surface as shown in FIG. 2. On top of the support stand 28*a*, a rectangular plate-shaped carrying plate 28*b* is provided so as to bring a support surface PL which is the top surface thereof in contact with the roll paper 12 so as to close off the opening in the top of the support stand 28*a*.

Formed in the carrying plate 28*b* are numerous (only five are shown in FIG. 1) through-holes A which pass vertically through the carrying plate 28*b* (in the thickness direction of the carrying plate 28*b*). An exhaust port B is formed in the left wall of the support stand 28*a*, and a suction fan 29 as suction means is connected via the exhaust port B. When the suction fan 29 is rotatably driven along with the rotatable driving of a suction fan motor (see FIG. 3) 30, the air in the space enclosed between the support stand 28*a* and the carrying plate 28*b* is expelled out via the suction fan 29. Specifically, the space enclosed between the support stand 28*a* and the carrying plate 28*b* constitutes a negative-pressure chamber 31 in which negative pressure is created based on the driving of the suction fan 29. In the first embodiment, a suction unit (equivalent to the "suction part") is configured from the suction fan 29, the suction fan motor 30, the negative-pressure chamber 31, the through-holes A, and other components.

When negative pressure is created in the negative-pressure chamber 31 along with the driving of the suction fan 29, the same negative pressure takes effect in the through-holes A of the carrying plate 28*b* communicated with the negative-pressure chamber 31. Therefore, the through-holes A of the carrying plate 28*b* function as suction holes for applying suction force to the roll paper 12 being conveyed over the support surface PL of the platen 28. The negative-pressure chamber 31 is also provided with a pressure detection sensor 32 for detecting pressure changes in the negative-pressure chamber 31 that accompany the rotatable driving of the suction fan 29.

In an area to the right of the platen 28 inside the printing chamber 22 as shown in FIG. 1, a second conveying roller pair 33 is provided for sandwiching and applying conveying force to the roll paper 12. Specifically, the second conveying roller pair 33 is provided to a position near the downstream end of the platen 28. The second conveying roller pair 33 is configured from a second drive roller 33*a* connected to a second conveying motor 34 (see FIG. 3) so as to enable the transmission of motive power, and a second driven roller 33*b* disposed so as to face the second drive roller 33*a* from the other side of the roll paper 12.

The roll paper 12 conveyed horizontally to the right from the first conveying roller pair 25 over the support surface PL of the platen 28 wraps over the second drive roller 33*a* from the left and above. The conveying direction of the roll paper 12 is then shifted from horizontally rightward to vertically downward. After the conveying direction of the roll paper 12 has been shifted to vertically downward by the second drive roller 33*a*, the roll paper 12 is conveyed vertically downward through a through-hole (not shown) provided in the base stand 21. The top surface of the second drive roller 33*a* is flush with both the top surface of the first drive roller 25*a* and the support surface PL of the platen 28. The second driven roller 33*b* is also configured so as to come in contact with the printing surface of the roll paper 12 only in the end edges in the width direction (the forward-backward direction). In the first embodiment, the conveying unit (equivalent to the "conveying part") is configured from the unreeling part 13, the winding part 15, the winding shaft 18, the relay roller 23, the relay roller 24, the first conveying roller pair 25, the second conveying roller pair 33, and other components.

On the front and back sides of the platen 28 inside the printing chamber 22, guide rails 35 (shown by a double-dotted line in FIG. 1) extending in the left-right direction are provided so as to form a pair. The top surfaces of the guide rails 35 are higher than the support surface PL of the platen 28. A rectangular plate-shaped carriage 35*a* is supported on the top surfaces of the guide rails 35 so as to be capable of moving back and forth in the left-right direction along the guide rails 35.

A recording head 36 (equivalent to the "recording part") is supported on the bottom surface of the carriage 35*a*. On the bottom surface of the recording head 36, numerous ink discharge nozzles (not shown) are arrayed in the forward-backward direction. A valve unit 37 for temporarily retaining ink is provided to the top wall of the main body case 16 inside the printing chamber 22. The valve unit 37 is connected to the recording head 36 via an ink supply tube (not shown). The recording head 36 performs printing by ejecting ink supplied from the valve unit 37 from the ink discharge nozzles onto the surface of the roll paper 12 which has been conveyed to and stopped on the platen 28.

Therefore, the area midway through the conveying route of the roll paper 12 and running from the left end to the right end of the platen 28 is a printing area R where printing is performed on the roll paper 12 by the ejecting of ink from the ink discharge nozzles. The roll paper 12 is intermittently conveyed in area units corresponding to the printing area R along the conveying route.

A heater unit 61 (equivalent to the "heating part) for heating the platen 28 is installed below the platen 28. Heat is then transferred to the roll paper 12 via the platen 28 heated by the heater unit 61, thereby promoting drying of the ink deposited on the roll paper 12. The platen 28 is provided with a temperature detection sensor 62 for detecting the temperature of the platen 28. Based on the temperature detected by the temperature detection sensor 62, a controller 44 (described hereinafter) controls the amount of heating by the heater unit 61 so that the platen 28 reaches a predetermined temperature (45° C., for example).

Figure 3:
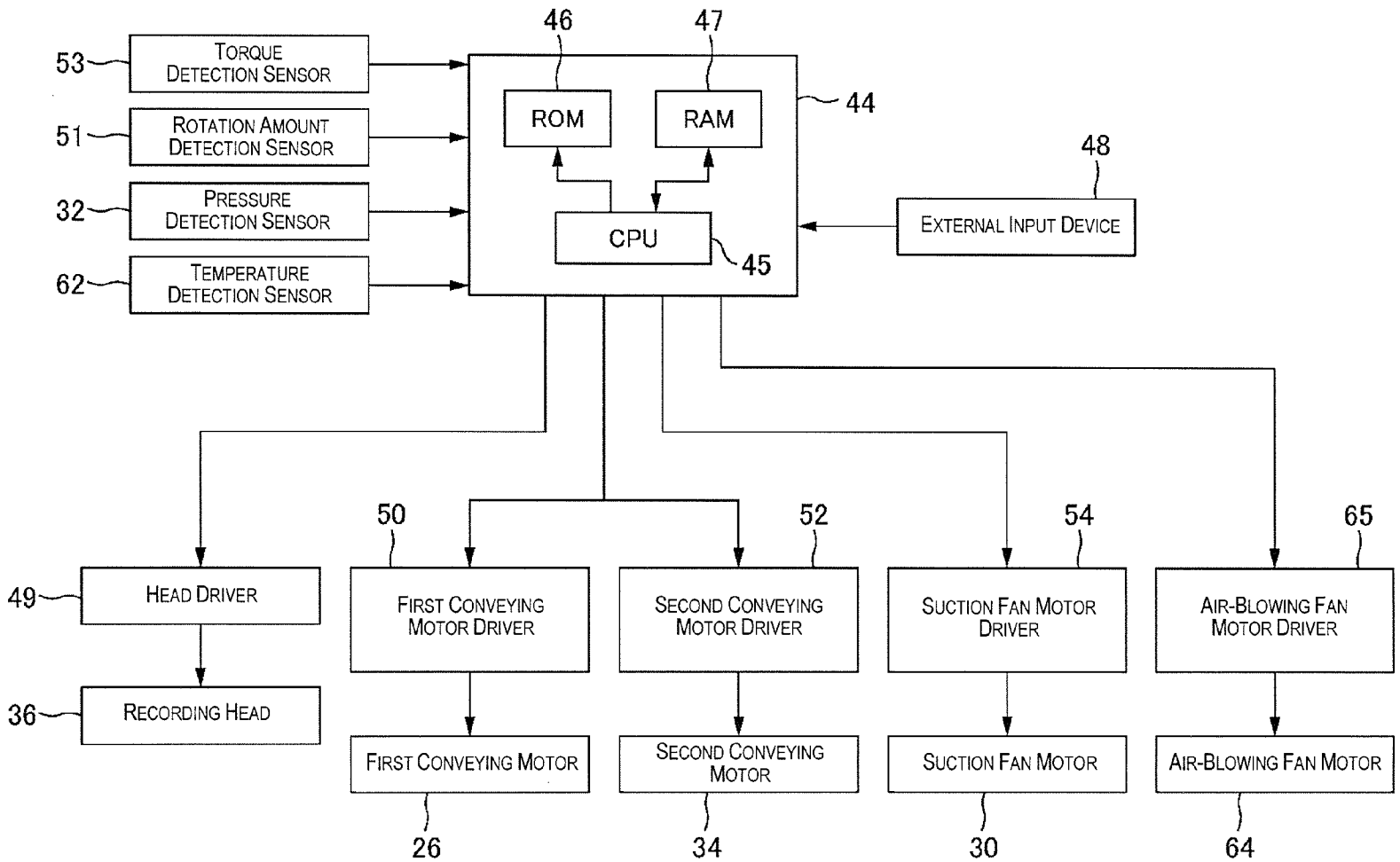
FIG. 3 is a block diagram of the control configuration of the printer 11.

In the upper portion of the main body case 16, an air-blowing fan 63 is provided which is rotatably driven along with the rotatable driving of an air-blowing fan motor 64 (see FIG. 3). The air-blowing fan 63 takes in air from outside the printer 11 and blows the air toward the roll paper 12 supported on the platen 28, thereby promoting drying of the ink deposited on the roll paper 12.

The roll paper 12 wrapped over the second drive roller 33*a* and conveyed vertically downward wraps over a reversal roller 38 from the left and above, the reversal roller 38 being rotatably disposed in a position vertically below the second drive roller 33*a* within the main body case 16, and the roll paper 12 is conveyed at a slightly upward incline to the right. The roll paper 12 conveyed from the reversal roller 38 then wraps over a relay roller 39 from the left and below, the relay roller 39 being rotatably provided to the right of the reversal roller 38 within the main body case 16, and the roll paper 12 is conveyed upward within the main body case 16 so as to run along the right wall of the main body case 16. After being subjected to printing in the printing area R, the roll paper 12 is naturally dried by the process of being conveyed through the main body case 16.

In a position near the base stand 21 in the right wall of the main body case 16, an outlet port (not shown) is provided for conveying the roll paper 12 out to the winding part 15. A feed-out roller 40 is rotatably provided in the main body case 16 in a position facing the position near the outlet port. The feed-out roller 40 is designed to feed the roll paper 12 out to the winding part 15 via the outlet port.

The winding part 15 has a right-angled parallelepiped winding frame 41. A relay roller 42 is rotatably provided to the top end of the winding frame 41. The roll paper 12 fed out from the inlet port is wrapped over the relay roller 42 from the left and above and conveyed to the right and downward.

To the right and obliquely below the relay roller 42 within the winding frame 41, a winding drive shaft 43 extending forward is supported to be capable of being rotatably driven relative to the winding frame 41. The roll paper 12 conveyed to the right and obliquely downward from the relay roller 42 is wrapped over the winding drive shaft 43. The roll paper 12 is sequentially wound up along with the rotatable driving of the winding drive shaft 43.

The main body 14 has a cleaning unit 66 (equivalent to the "cleaning part") in the upper left of interior of the main body 14. The cleaning unit 66 is a mechanism for cleaning the recording head 36 either at the start of the recording action or after the elapse of a specified time duration following the previous cleaning or some other predetermined timing, so that the recording head 36 is capable of appropriately discharging ink. The cleaning unit 66 has a suction pump (not shown) as a negative-pressure source for drawing in the ink, a wiper (not shown) for scraping and cleaning the discharge port surface of the recording head 36, and other components. Cleaning the recording head 36 involves alleviating clogging in the nozzles, removing ink or waste deposited on the nozzle surface, or other forms of cleaning through flushing by the suction pump or wiping by the wiper. When the recording head 36 is cleaned, the carriage 35*a* conveys the recording head 36 to the cleaning unit 66. One cleaning action of the cleaning unit 66 takes approximately three to ten minutes.

Control of Printer

Next, the control in the printer 11 of the present embodiment will be described. FIG. 3 is a block diagram of the control configuration of the printer of the first embodiment.

The printer 11 is provided with a controller 44 for controlling the drive state of the entire device, as shown in FIG. 3. The controller 44 has a CPU 45 as a central processing unit, ROM 46, and RAM 47. The ROM 46 stores processing routine programs and the like pertaining to the recording action and the cleaning action shown in the flowchart in FIG. 4. The RAM 47 temporarily stores computation results of the CPU 45 and temporarily stores print data and the like inputted from an external input device 48.

The controller 44 is connected to the recording head 36 via a head driver 49. The controller 44 reads from the RAM 47 the print data inputted from the external input device 48, and sends the read print data to the head driver 49. The head driver 49 discharges ink droplets from the ink discharge nozzles of the recording head 36 on the basis of the print data received from the controller 44.

The controller 44 drivably controls the first conveying motor 26 via a first conveying motor driver 50. As the first conveying motor 26 is rotatably driven, the first drive roller 25*a* conveys the roll paper 12 downstream in the conveying direction until the conveyed amount reaches a predetermined amount based on the rotated amount of the first conveying motor 26.

Connected to the controller 44 is a rotation amount detection sensor 51 for detecting the rotation amount of the first conveying motor 26. The controller 44 is designed to perform feedback control on the rotation amount of the first conveying motor 26 via the first conveying motor driver 50, on the basis of the detection result of the rotation amount of the first conveying motor 26 received from the rotation amount detection sensor 51.

The controller 44 drivably controls the second conveying motor 34 via a second conveying motor driver 52. As the second conveying motor 34 is rotatably driven, the second drive roller 33*a* subjects the roll paper 12 to a predetermined amount of tension based on the torque of the second conveying motor 34.

A torque detection sensor 53 for detecting the torque of the second conveying motor 34 is connected to the controller 44. The controller 44 is designed to perform feedback control on the torque of the second conveying motor 34 via the second conveying motor driver 52, on the basis of the detection result of the torque of the second conveying motor 34 received from the torque detection sensor 53.

The controller 44 also controls the heating amount of the heater unit 61 so that the platen 28 reaches a predetermined temperature (45° C., for example), on the basis of the temperature detected by the temperature detection sensor 62. Therefore, drying of the ink deposited on the roll paper 12 is promoted by the platen 28, which is kept at the predetermined temperature.

The controller 44 also drivably controls the suction fan motor 30 via a suction fan motor driver 54. As the suction fan motor 30 is rotatably driven, the suction fan 29 reduces the pressure in the negative-pressure chamber 31 by a predetermined suction force based on the rotating speed of the suction fan motor 30. As a result, the negative pressure in the negative-pressure chamber 31 acts on the roll paper 12 via the through-holes A of the carrying plate 28*b*, as a suction force against the support surface PL of the platen 28.

The controller 44 drivably controls the air-blowing fan motor 64 via an air-blowing fan motor driver 65. The air-blowing fan 63 then rotates along with the rotatable driving of the air-blowing fan motor 64, air is taken in from outside the printer 11, and the air is blown toward the roll paper 12 supported on the platen 28. As a result, drying of the ink deposited on the roll paper 12 is promoted.

Operation of Printer

Figure 4:
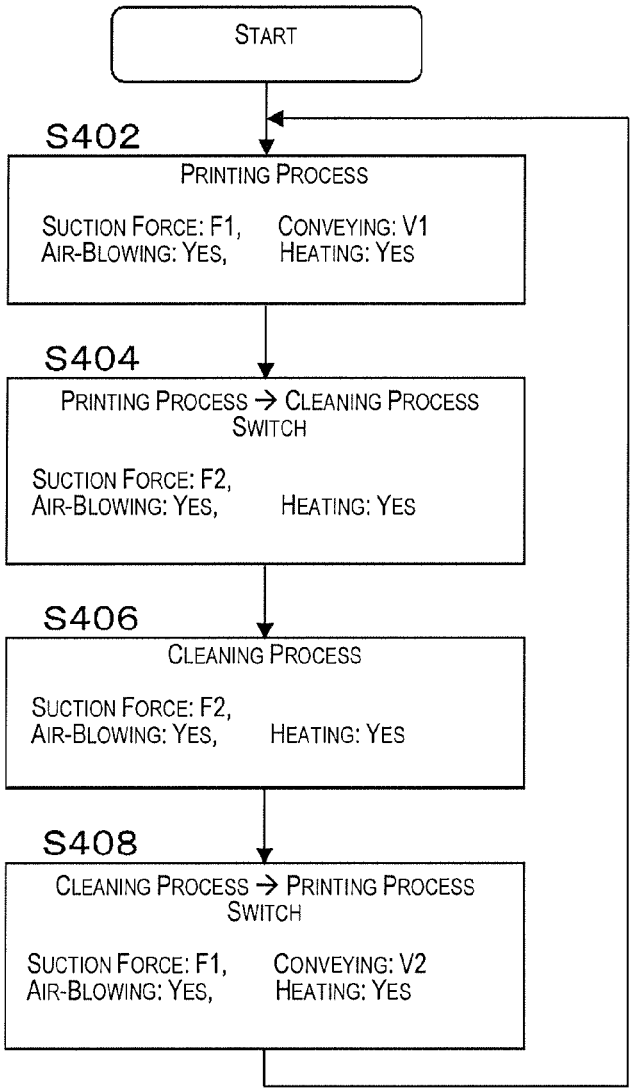
FIG. 4 is a flowchart describing the action of the printer 11.

Next, the action of the printer 11 configured in the above manner will be described. FIG. 4 is a flowchart describing the action of the printer 11. The controller 44 controls the recording action and the cleaning action in the printer 11 by reading and executing from the ROM 46 the process routine programs pertaining to the actions of the printer 11. In the present embodiment, in a first stage in which the controller 44 executes the routine programs pertaining to the recording action and the cleaning action, the print data used by the recording head 36 on the roll paper 12 is inputted in advance from the external input device 48 to the RAM 47.

When a print command is received from the external input device 48, the controller 44 executes the recording action as shown in FIG. 4 (S402). When the recording action is executed, the controller 44 drivably controls the suction fan motor 30 and causes the suction fan 29 to expel the air in the negative-pressure chamber 31 out to the exterior so that the pressure in the negative-pressure chamber 31 detected by the pressure detection sensor 32 reaches a first pressure P1 (840 Pa, for example). The negative pressure in the negative-pressure chamber 31 acts so as to hold the roll paper 12 to the support surface PL of the platen 28 by suction with a suction-force F1 (equivalent to the "first suction force") via the through-holes A of the carrying plate 28*b*. When executing the recording action, the controller 44 controls the heating amount of the heater unit 61 so that the platen 28 reaches a predetermined temperature (45° C., for example) on the basis of the temperature detected by the temperature detection sensor 62, and also drivably controls the air-blowing fan motor 64 so that the amount of air blown by the air-blowing fan 63 reaches a predetermined amount, thereby promoting drying of the ink deposited on the roll paper 12.

When executing the recording action, the controller 44 causes the recording head 36 to discharge ink (hereinbelow the "discharging process") onto the portion of the roll paper 12 positioned above the support surface PL of the platen 28 (hereinbelow the "platen-top portion"). Specifically, the controller 44 causes an image to be recorded on this portion (the platen-top portion) by executing the discharge process. Next, the controller 44 causes the conveying unit to convey the roll paper 12 (hereinbelow the "conveying process"). Specifically, the controller 44 executes the conveying process, causing the portion of the roll paper 12 on which the image is recorded to be ejected off of the support surface PL of the platen 28, and conveys the portion of the roll paper 12 where the next image will be recorded onto the support surface PL of the platen 28. During this conveying process, the controller 44 controls the conveying unit so that the conveying speed at which the conveying unit conveys the roll paper reaches a first speed V1 (600 mm/s, for example). Thus, when the recording action is executed, the controller 44 repeatedly alternates between executing the discharge process and executing the conveying process.

Next, when the recording action has been continuously executed for a predetermined time duration, the controller 44 halts the recording action and executes a switch for executing a cleaning action for cleaning the recording head 36 (S404). Specifically, the controller 44 causes the carriage 35*a* to convey the recording head 36 to the cleaning unit 66. When a switch is made from the recording action to the cleaning action, the controller 44 drivably controls the suction fan motor 30 and causes the suction fan 29 to expel the air in the negative-pressure chamber 31 out to the exterior so that the pressure in the negative-pressure chamber 31 detected by the pressure detection sensor 32 reaches a second pressure P2

(P2<P1; 140 Pa, for example). Specifically, the controller 44 drivably controls the suction fan motor 30 so that the suction force for holding the roll paper 12 to the support surface PL of the platen 28 by suction changes from the suction force F1 to the suction force F2 (F2<F1; equivalent to the "second suction force"). When a switch is made from the recording action to the cleaning action, the roll paper 12 is not conveyed, and the portion of the roll paper 12 on which the image has been recorded is left on the support surface PL of the platen 28. Even during switching, the controller 44 continues to control the heating amount of the heater unit 61 so that the platen 28 reaches a predetermined temperature (45° C., for example) on the basis of the temperature detected by the temperature detection sensor 62, and also drivably controls the air-blowing fan motor 64 so that the amount of air blown by the air-blowing fan 63 reaches a predetermined amount, thereby promoting drying of the ink deposited on the roll paper 12.

Furthermore, the controller 44 causes the cleaning unit 66 to execute the action of cleaning the recording head 36 (S406). When the cleaning action is executed, the controller 44 causes the cleaning unit 66 to execute the cleaning action by washing, wiping, or the like. At this time, the controller 44 drivably controls the suction fan motor 30 so that the roll paper 12 is held by suction to the support surface PL of the platen 28 with a suction force F2. One cleaning action of the cleaning unit 66 takes approximately three to ten minutes. During the cleaning action, the roll paper 12 is not conveyed, and the portion of the roll paper 12 on which the image has been recorded is left on the support surface PL of the platen 28. Even during the cleaning action, the controller 44 continues to control the heating amount of the heater unit 61 so that the platen 28 reaches a predetermined temperature (45° C., for example) on the basis of the temperature detected by the temperature detection sensor 62, and also rotates the air-blowing fan 63 by drivably controlling the air-blowing fan motor 64, which promotes drying of the ink deposited on the roll paper 12.

After the cleaning action has ended, the controller 44 executes a switch from the cleaning action to the recording action (S408). Specifically, the controller 44 causes the carriage 35*a* to convey the recording head 36 from the cleaning unit 66 to a position above the platen 28. At this time, the controller 44 drivably controls the suction fan motor 30 and causes the suction fan 29 to expel the air in the negative-pressure chamber 31 out to the exterior so that the pressure in the negative-pressure chamber 31 detected by the pressure detection sensor 32 reaches the first pressure P1. The negative pressure in the negative-pressure chamber 31 acts via the through-holes A of the carrying plate 28*b* so as to hold the roll paper 12 to the support surface PL of the platen 28 by a suction force F1. The controller 44 then causes the conveying unit to execute the conveying process of conveying the roll paper 12, the portion of the roll paper 12 on which the image is recorded is ejected off of the support surface PL of the platen 28, and a portion of the roll paper 12 where a new image will be recorded is conveyed onto the support surface PL of the platen 28. During this conveying process, the controller 44 controls the conveying unit so that the conveying speed whereby the conveying unit conveys the roll paper reaches a second speed V2 (V2<V1; 50 mm/sec, for example). Even after the cleaning action has ended, the controller 44 continues to control the heating amount of the heater unit 61 so that the platen 28 reaches a predetermined temperature (45° C., for example) on the basis of the temperature detected by the temperature detection sensor 62, and also to drivably control the air-blowing fan motor 64 so that the amount of air blown by the air-blowing fan 63 reaches a predetermined amount, thereby promoting drying of the ink deposited on the roll paper 12.

In this manner, the controller 44 again executes the recording action (S402).

Effectiveness of Printer

As described above, with the printer 11 (and the controller 44 thereof) according to the first embodiment, the occurrence of wrinkles in the roll paper 12 can be minimized by including the conveying unit for conveying the roll paper 12, the platen 28 for supporting the roll paper 12, the recording head 36 for discharging liquid and recording an image on the roll paper 12 being supported by the platen 28, the heater unit 61 for drying the liquid discharged onto the roll paper 12 by heating the platen 28, the cleaning unit 66 for cleaning the recording head 36, and the controller 44 for causing the conveying unit to convey the roll paper 12 at a first speed V1 when the recording head 36 is made to perform the recording action of recording an image and for causing the conveying unit to convey the roll paper 12 at a second speed V2 which is slower than the first speed V1 after the cleaning unit 66 is made to perform the cleaning action of cleaning the recording head 36.

Figure 5:
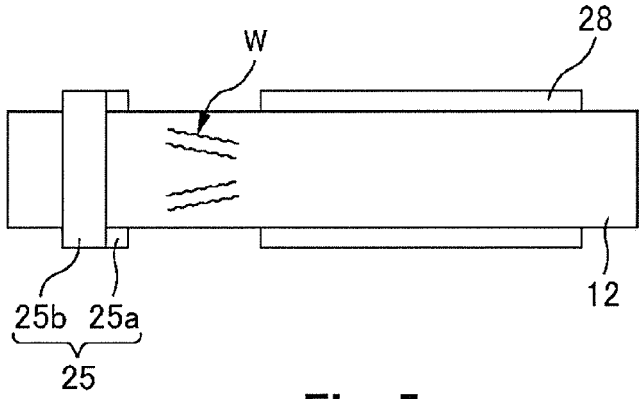
FIG. 5 is a top view showing the positional relationship of roll paper 12 to a first conveying roller pair 25 and to the platen 28.

Specifically, the heat of the heated platen 28 and the air blown by the air-blowing fan 63 promote drying of the ink deposited on the roll paper 12 and also promote drying of the portion of the roll paper 12 positioned on the platen 28 (the platen-top portion). Since the roll paper 12 is sequentially conveyed during the recording action, a specified portion of the roll paper 12 (the platen-top portion) is not subjected for a long period of time to the promotion of drying by the platen 28 and the air-blowing fan 63, and the drying of the specified portion of the roll paper 12 (the platen-top portion) alone does not progress. However, during the cleaning action, since the roll paper 12 comes to a stop, the specified portion of the roll paper 12 (the platen-top portion) alone is retained on the platen 28 and subjected to the promotion of drying by the platen 28 and the air-blowing fan 63, and drying of the specified portion of the roll paper 12 (the platen-top portion) progresses. When the state is such that drying of the specified portion of the roll paper 12 (the platen-top portion) is progressing and the portion of the roll paper 12 adjacent to this portion (the portion of the roll paper 12 positioned nearby upstream in the conveying direction as seen from the platen 28 during the cleaning action; hereinbelow the "upstream portion") is not being dried very much, there is a large difference in the extent of drying between continuous adjacent portions of the roll paper 12, and wrinkles are likely to occur. When the roll paper 12 is conveyed at the first speed V1 while in this state of being prone to wrinkles and the upstream portion of the roll paper 12 moves onto the platen 28, the upstream portion of the roll paper 12 is rubbed (brushed) by the upstream end of the platen 28, whereby wrinkles sometimes occur in the upstream portion of the roll paper 12 (see FIG. 5). FIG. 5 is a top view showing the positional relationship of the roll paper 12 relative to the first conveying roller pair 25 and the platen 28. When the roll paper 12 is conveyed after the cleaning action, as shown in this drawing, wrinkles W sometimes occur in the upstream portion of the roll paper 12.

However, with the printer 11 of the first embodiment, by causing the conveying unit to convey at a second speed V2 which is slower than the first speed V1, i.e. by slowly conveying the portion of the roll paper 12 that is prone to wrinkles after the cleaning unit 66 is made to execute the cleaning action, the occurrence of wrinkles in the roll paper 12 can be minimized. In other words, the occurrence of wrinkles in the upstream portion of the roll paper 12 can be minimized by ensuring that the upstream portion of the roll paper 12 is not rubbed at high speeds (not brushed at high speeds) by the upstream end of the platen 28 during conveying after the cleaning action.

With the printer 11 according to the first embodiment, the controller 44 causes the suction unit to hold the roll paper 12 to the wrinkle prevention plate 27 by a first suction force F1 when the recording head 36 is made to perform the recording action of recording an image, and causes the suction unit to hold the roll paper 12 to the platen 28 by second suction force F2 which is less than the first suction force F1 when the cleaning unit 66 is made to perform the cleaning action of cleaning the recording head 36, whereby the occurrence of wrinkles in the roll paper 12 anne further minimized.

Specifically, to prevent the portion of the roll paper 12 positioned over the platen 28 (the platen-top portion) from coming in contact with the recording head 36 during the recording action, the roll paper 12 must be restrained on the platen 28 by a strong suction force (the first suction force F1). On the other hand, there is no need to restrain the roll paper 12 on the platen 28 with a strong suction force because there is no risk of the platen-top portion of the roll paper 12 coming in contact with the recording head 36. As described above, during the cleaning action, there is a state in which drying of the specified portion of the roll paper 12 (the platen-top portion) is promoted and wrinkles are likely to occur, but at this time, the occurrence of wrinkles can be minimized by lessening the suction force (suction is applied with the second suction force F2 which is a lesser suction force) to lessen the force of restraining the platen-top portion of the roll paper 12 on the platen 28, and allowing some freedom to the platen-top portion of the roll paper 12.

With the printer 11 according to the first embodiment, the controller 44 actuates the air-blowing fan 63 when the recording head 36 is made to perform the recording action and when the cleaning unit 66 is made to perform the cleaning action of cleaning the recording head 36, whereby wrinkles in the roll paper 12 can be further minimized.

Specifically, as described above, the platen-top portion of the roll paper 12 is dried by the heat of the platen 28 and the air blown by the air-blowing fan 63 during the cleaning action. When drying of the platen-top portion of the roll paper 12 is promoted and drying of the upstream portion of the roll paper 12 adjacent thereto is not promoted, there is a large difference in the extent of drying between the platen-top portion and the upstream portion, and wrinkles are likely to occur. With the printer 11 according to the first embodiment, drying of the upstream portion of the roll paper 12 can be promoted as well as of the platen-top portion of the roll paper 12 by actuating the air-blowing fan 63 not only during the recording action but also during the cleaning action, the difference in the extent of drying between the platen-top portion and upstream portion of the roll paper 12 can be prevented from being too large, and the occurrence of wrinkles in the roll paper 12 can thereby be minimized.

Other Embodiments

The first embodiment pertains primarily to the recording device, but also includes the disclosure of the method for controlling a recording device and the like. The first embodiment is intended to make the present invention easier to understand and should not be interpreted as limiting the present invention. The present invention can be modified and improved without deviating from the scope of the invention, and such equivalents are of course included within the present invention. The embodiments described hereinbelow in particular are included in the present invention.

In the first embodiment, after making the cleaning unit 66 perform the cleaning action of cleaning the recording head 36, the controller 44 causes the conveying unit to convey the roll paper 12 at the second speed V2 which is slower than the first speed V1, but another option is to cause the conveying unit to convey the roll paper 12 at the second speed V2 until the region of the roll paper 12 that was wrapped over the first conveying roller pair 25 (hereinbelow the "roller region") during the cleaning action is conveyed past the end of the platen 28 that is upstream in the conveying direction, and to cause the conveying unit to convey the roll paper 12 at a faster speed than the second speed V2 after the roller region has been conveyed past the end of the platen 28 that is upstream in the conveying direction.

Specifically, the portion of the roll paper 12 most prone to wrinkles is the portion of the roll paper 12 that is positioned between the first conveying roller pair 25 and the upstream end of the platen 28 during the cleaning action. After the cleaning action has ended, the occurrence of wrinkles in the roll paper 12 can be minimized by slowly conveying this wrinkle-prone portion. After the wrinkle-prone portion has passed over the upstream end of the platen 28, the controller 44 can reduce the time needed to convey the roll paper 12 by causing the conveying unit to convey the roll paper 12 at a faster speed than the second speed V2.

In the first embodiment, the configuration may be provided with an atmosphere opening valve for opening the interior of the negative-pressure chamber 31 to the atmosphere. In this case, it is possible to quickly reduce the rate of depressurization in the negative-pressure chamber 31 by opening the interior of the negative-pressure chamber 31 to the atmosphere by the atmosphere opening valve at the same time the suction force within the negative-pressure chamber 31 via the suction fan 29 is reduced.

In the first embodiment, instead of providing a pressure detection sensor for detecting the pressure change in the negative-pressure chamber 31, a flow rate detection sensor may be provided for detecting the flow rate of air vented from within the negative-pressure chamber 31 by the suction fan 29. In this case, it can be determined that depressurization of the interior of the negative-pressure chamber 31 by the suction fan 29 is complete at the point in time when the controller 44 receives from the flow rate detection sensor a detection signal indicating that the flow rate of the air vented from within the negative-pressure chamber 31 by the suction fan 29 has fallen below a predetermined threshold.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A recording device comprising:

a conveying part configured and arranged to convey a roll paper;

a support part configured and arranged to support the roll paper;

a recording part configured and arranged to eject liquid on the roll paper to record an image on the roll paper supported by the support part;

a heating part configured and arranged to heat the support part to dry the liquid ejected onto the roll paper;

a cleaning part configured and arranged to clean the recording part; and a controller configured to control the conveying part to convey the roll paper at a first speed when the recording part performs a recording action for recording the image, and to control the conveying part to convey the roll paper at a second speed, which is slower than the first speed, after the cleaning part performs a cleaning action for cleaning the recording part.

2. The recording device according to claim 1, wherein the conveying part includes a plurality of rollers over which the roll paper wraps, the rollers including a proximal roller at a position nearest to the support part among the rollers disposed upstream of the support part in the conveying direction, the controller is configured to, after the cleaning part performs the cleaning action for cleaning the recording part, control the conveying part to convey the roll paper at the second speed until a region of the roll paper wrapped over the proximal roller during the cleaning action is conveyed past an upstream end of the support part with respect to the conveying direction, and control the conveying part to convey the roll paper at a faster speed than the second speed after the region has been conveyed past the upstream end of the support part.

3. The recording device according to claim 1, further comprising a fan configured and arranged to blow air toward the roll paper to dry the liquid discharged onto the roll paper, the controller being configured to actuate the fan when the recording part performs the recording action for recording the image and when the cleaning part performs the cleaning action for cleaning the recording part.

4. The recording device according to claim 3, further comprising a suction part configured and arranged to hold the roll paper to the support part by suction, the controller being configured to control the suction part to use a first suction force to hold the roll paper to the support part by suction when the recording part performs a recording action for recording the image, and to control the suction part to use a second suction force, which is weaker than the first suction force, to hold the roll paper to the support part by suction when the cleaning part performs a cleaning action for cleaning the recording part.

5. A method for controlling a recording device comprising:

when a recording part performs a recording action for discharging a liquid and recording an image on a roll paper supported by a heated support part, controlling a conveying part to convey, at a first speed, the roll paper supported by the support part; and after a cleaning part performs a cleaning action for cleaning the recording part, controlling the conveying part to convey, at a second speed that is slower than the first speed, the roll paper supported by the support part.

* * * * *